United States Patent [19]

Stark

[11] Patent Number: 4,761,966

[45] Date of Patent: Aug. 9, 1988

[54] DEHUMIDIFICATION AND COOLING SYSTEM

[76] Inventor: Walter Stark, 38 Upland Dr., East Northport, N.Y. 11731

[21] Appl. No.: 874,544

[22] Filed: Jun. 16, 1986

Related U.S. Application Data

[63] Continuation-in-part of Ser. No. 662,590, Oct. 19, 1984, abandoned.

[51] Int. Cl.[4] ..... F25B 49/00

[52] U.S. Cl. ..... 62/176.6; 62/186; 62/173; 236/44 C

[58] Field of Search ..... 62/176.5, 176.6, 173, 62/90, 186; 165/21, 34, 35; 236/44 C, 44 A, 44 R

[56] References Cited

U.S. PATENT DOCUMENTS 1,827,099 10/1931 Otos ..... 165/21
1,986,863 1/1935 Terry ..... 62/173
2,093,968 9/1937 Kettering ..... 62/176.6
2,702,456 2/1955 Ringquist et al. ..... 62/173
4,517,810 5/1985 Foley et al. ..... 62/186

*Primary Examiner*—Harry B. Tanner
*Attorney, Agent, or Firm*—Morgan & Finnegan

[57] ABSTRACT

A self-regulating humidity, air temperature, and water temperature control system for indoor swimming pools and other high humidity water chambers comprises a circulating fan, a series of plenums and an air-to-air heat exchanger. Warm, humid air is drawn through one side of the heat exchanger by the fan to precool the exhaust air by thermal exchange with cooler air prior to passage through a dehumidification and cooling coil. The dehumidified and cooled air is then drawn back through the opposite side of the air-to-air heat exchanger to be preheated. A set of dampers operated by an actuator allows air to bypass the heat exchanger to regulate the amount of air that passes therethrough according to pool room air temperature.

6 Claims, 3 Drawing Sheets

DEHUMIDIFICATION AND COOLING SYSTEM

This application is a continuation-in-part of U.S. patent application Ser. No. 662,590 filed Oct. 19, 1984 abandoned.

BACKGROUND OF THE INVENTION

The invention pertains to dehumidification and cooling systems. More particularly, the invention pertains to a self-regulating air temperature, humidity and water temperature regulating system for an indoor swimming pool or spa.

A prior known dehumidification and cooling system for an indoor pool is illustrated by way of reference to FIG. 1. In the system of FIG. 1, a stream A of hot, humid air typically at about 80°, drawn from a pool area, passes through a cooling and dehumidification coil 1, and exits the coil 1 as a dehumidified and cooled air stream C, typically at about 55° F. Air stream C then passes through a heating coil 2 before returning to the pool as dehumidified and warmed air D, typically at about 70° F. or higher. Such prior art systems require considerable external energy sources to cool and then reheat the air.

The air volume in these prior systems is generally dictated by the requirements of a hot-gas heating coil which is regulated by a refrigeration circuit. This results in a higher air volume in the duct system than is necessary for dehumidification, resulting in a larger and more costly duct system. This greater air volume also causes increased turbulance, resulting in bather discomfort and an increased rate of water surface evaporation. Also, since a substantial amount of heat is rejected into the air stream by the hot-gas coil, over-heating of the pool room occurs at lower outdoor temperatures, causing the need for premature cooling or venting.

Some prior systems attempt to use precooled and reheated air through an air-to-air heat exchange system. These systems, commonly referred to as run-around systems, comprise an air-to-water heat exchanger for precooling and reheating air. Such prior systems require piping, a water circulating pump, and considerable external energy to run the water circulating pump and to compensate for loss of sensible heat in the piping and in the transfer from the medium of air to water and back to air.

The prior known systems have not, it is believed, satisfactorily addressed the specific air volume, humidity, and air and water temperature problems associated with high humidity environments such as indoor swimming pools. Indoor pools have long been in existence and there is substantial need for an energy efficient system to control the exaggerated air volume, humidity, and air and water temperature problems of such environments.

Equipment reliability is also a very important factor in high humidity indoor swimming pool environments. Breakdowns result in uncontrolled humidity which can cause condensation and subsequent building deterioration and structural damage. Dehumidification and cooling systems are, however, subjected to strenuous and often year-round operating conditions. Expansion, contraction and vibration of high temperature and high pressure refrigeration lines play a large role in the frequency of breakdown. It has thus been preferable to minimize the amount of system refrigeration piping and fittings and to have them assembled in a controlled environment, such as a factory, and not on site. The use of a remote air-cooled refrigeration condenser, however, requires substantial refrigeration piping and fittings, and has resulted in breakdowns and a substantial degree of unreliability.

It is therefore an object of the invention to provide a humidity, air temperature and water temperature control system for indoor pools and spas, having minimal air and water flow requirements, minimal energy consumption, and a high degree of reliability.

It is a further object of the invention to provide a self-regulating system for adjusting the humidity, the air temperature and the water temperature in the pool according to demand.

SUMMARY OF THE INVENTION

These and other objects of the invention are met by providing a self-regulating system for the integrated control of humidity, air temperature and water temperature in indoor swimming pools and spas. A preferred embodiment of the invention includes a circulating fan which draws warm, humid air from the pool area through an air-to-air heat exchanger to precool the exhaust air by thermal exchange with cooler air prior to passage through a dehumidification and cooling coil. The fan draws the cooled air back through the air-to-air heat exchanger to preheat the cooled and dehumidified air which then passes through reheat and auxiliary heat coils prior to entry back into the pool. A set of dampers operated by an actuator and controlled by a room temperature controller allows air to bypass the heat exchanger so that the amount of air which passes through the heat exchanger may be regulated according to increases and decreases in pool temperature due to sensible heat sources such as solar heat gain, interior lighting and body temperature. The dehumidification and cooling coils may be regulated by a refrigeration compressor, or other means controlled by a humidistat or other humidity controlling means to regulate with increases or decreases in humidity.

A system according to one embodiment of the invention heats pool water through a refrigerant-to-water condenser which may be activated by a refrigeration compressor controlled by a pool water thermostat to regulate with increases or decreases in pool water temperature. Humidity, air temperature, and water temperature may be regulated through a refrigeration circuit.

Air temperature is first regulated using a set of dampers to control the volume of air that bypasses and enters the air-to-air heat exchanger. Second, air temperature is regulated by the flow of hot-gas through a reheat coil, hot-gas flow being controlled, during compressor operation, by a hot-gas reheat valve. Air temperature may be further regulated by an auxiliary heating coil which uses an external source of energy such as gas, oil, hot water, steam or electric.

Water temperature may be regulated by a refrigerant-to-water condenser, a cooling-tower and a three way water temperature control valve. Water from the circulating pump and filter system flows through the refrigerant-to-water condenser and absorbs heat from hot refrigerant gas. A pressure actuated water regulating valve meters the appropriate volume of water through the refrigerant-to-water condenser. Remaining water bypasses the refrigerant-to-water condenser and mixes with water leaving the refrigerant-to-water condenser and enters a three way water temperature control valve where the heated water is diverted to the pool, when heat is needed, or to a water cooling-tower, when pool water temperature and hot-gas reheat requirements are satisfied.

The system manages water and air temperature and humidity with a control system that automatically adjusts to changing conditions and optimizes the use of energy.

DESCRIPTION OF THE DRAWINGS

The invention will be described in greater detail below by way of reference to the following drawings, in which.

DETAILED DESCRIPTION OF THE PREFERRED EMBODIMENT

Figure 1:
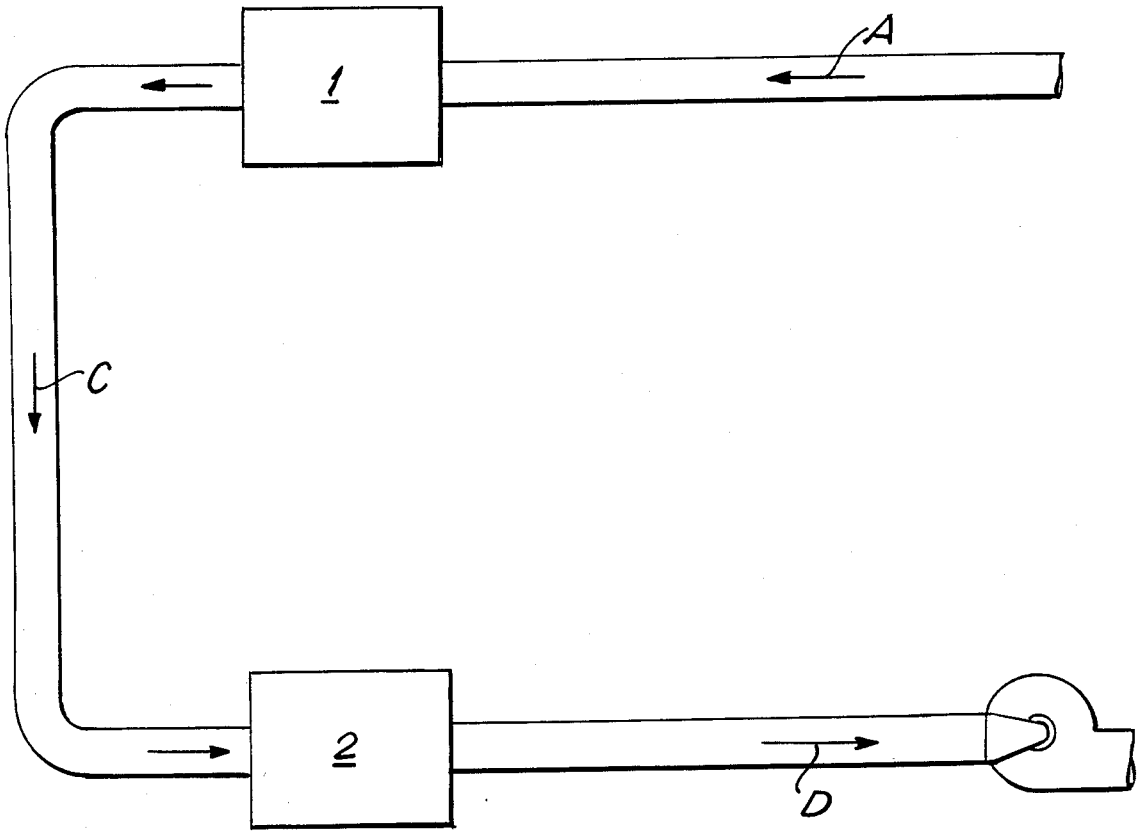
(PRIOR ART) FIG. 1
FIG. 1 is an illustration of a conventional system of the prior art.
Figure 2:
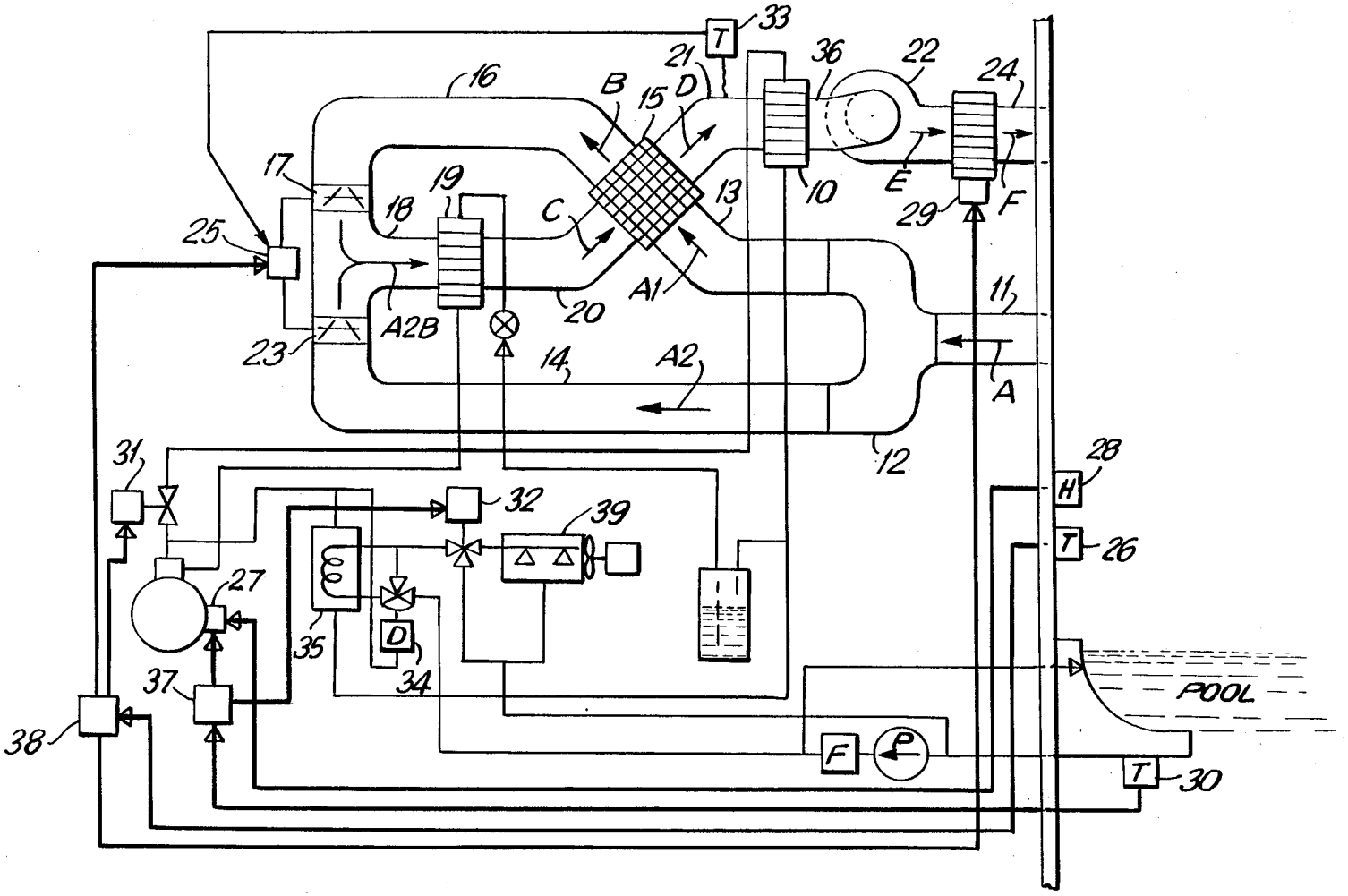
FIG. 2 is an illustration of one embodiment of the instant invention.

One embodiment of the invention, as shown in FIG. 2, comprises an inlet air duct 11 which introduces warm humid air, A, typically at about 80° F. from an indoor swimming pool. The air duct 11 is connected to a duct plenum 12, which plenum is further connected to two optional plenums, 13 and 14.

Plenum 13 is connected to a conventional stationary air-to-air heat exchanger 15 which may be a non-rotating air-to-air heat exchanger such as a fixed plate exchanger. Heat exchanger 15 precools air stream A1, typically to about 65° F., and exits the air as air stream B. Heat exchanger 15 is connected to a plenum 16, the exit end of which is connected to a damper 17.

A damper actuator 25 controls damper 17 and 23 in inverse order. When damper 17 is open, second damper 23 is closed, and air stream B enters plenum 18, to become air stream A2B. Air stream A2B is then introduced into a conventional dehumidification and cooling coil 19. In dehumidification and cooling coil 19, air stream A2B is dehumidified and cooled, typically to about 55° F., and exits into plenum 20 as air stream C. Thereafter, air stream C enters the opposite side of the air-to-air heat exchanger 15. Air stream C is thereby preheated, typically to about 70° F., utilizing the energy supplied by warmer air stream A1, and thereafter exits heat exchanger 15 into plenum 21 as air stream D, which enters reheat coil 10.

Air exits reheat coil 10 as air stream E, typically at a maximum temperature of about 105° F., into plenum 36 which is the air inlet to circulating fan 22. Circulating fan 22, in this embodiment, provides the means for circulating all air streams. Air exits circulating fan 22 and enters auxiliary heating coil 29 for further heating as conditions require. Air leaves auxiliary heating coil 29, through exit duct 24, as air stream F, into the indoor swimming pool or spa room.

The invention provides a means of dehumidifying air by utilizing energy supplied by air stream C, to precool the inlet air stream A1, and by utilizing the energy supplied by air stream A1, to reheat air stream C, thereby reducing total energy consumption from conventional sources.

When the pool room temperature rises above 80° F., as determined by a temperature control 26 through staging control 38, damper actuator 25 opens damper 23 and closes damper 17, thereby opening air stream A2 and closing air stream B, resulting in air stream A2B which is routed through the dehumidification and cooling coil 19 without previously passing through heat exchanger 15. As air stream A1 has been stopped, no heat is conducted to air stream C, which is dehumidified and at a cooler temperature because it has not been reheated. Temperature control 26, through staging control 38, controls damper actuator 25 which permits dampers 17 and 23 to be inversely opened and closed in varying degrees except as limited by discharge control 33 which may be provided to prevent the air temperature from falling below the design dew point of the indoor pool.

When damper 17 is fully open and damper 23 is fully closed, and the pool air temperature is lower than the set point (e.g., 80°) on temperature sensor 26, staging control 38 opens hot-gas valve 31, sending hot-gas to reheat coil 10, thereby reheating the air and raising pool air temperature. If the pool air temperature continues to drop below the set point on temperature sensor 26, staging control 38 energizes auxiliary heater 29, further adding heat to the pool air.

When the humidity in the pool room rises above set point, as determined by a humidity control 28, the refrigeration compressor 27 is energized, causing cooling medium to stream through cooling and dehumidifying coil 19, thereby dehumidifying and cooling air stream A2B.

Water temperature is controlled by a refrigerant-to-water condenser 35 which transfers heat from the hot refrigerant gas to pool water. The heated water is diverted through temperature control valve 32 to the pool if heat is required or to the water cooling-tower 39. However, when air reheating is required through the hot-gas coil 10 as determined by the automatic control system, the heat is rejected through the hot-gas reheat coil instead of the cooling-tower 39.

The refrigeration system components and operation, together with the air-to-air heat exchanger, are particularly suited to high humidity environments. A pressure actuated water regulating valve 34 may be provided to control the refrigeration system's discharge pressure by regulating the flow of cooling water through the refrigerant-to-water condenser 35. The hot-gas reheat coil 10, which may be slightly undersized, may be supplemented with a refrigerant-to-water condenser 35. Precise refrigerant discharge pressure control may thus be achieved with the pressure actuated water regulating valve 34.

Once humidity, air and water temperatures stabilize, the system produces an excess of heat. This heat may be used first for water heating, second for hot-gas air reheating, and finally, all other conditions being satisfied, the excess heat may be rejected to the outdoors by temperature control valve 32, through water cooling-tower 33. During initial water heating or after the water set point temperature is raised, there may be a temporary condition that requires more energy for heating pool water than is needed to dehumidify. This need may be met by adding auxiliary heater 29.

Figure 3:
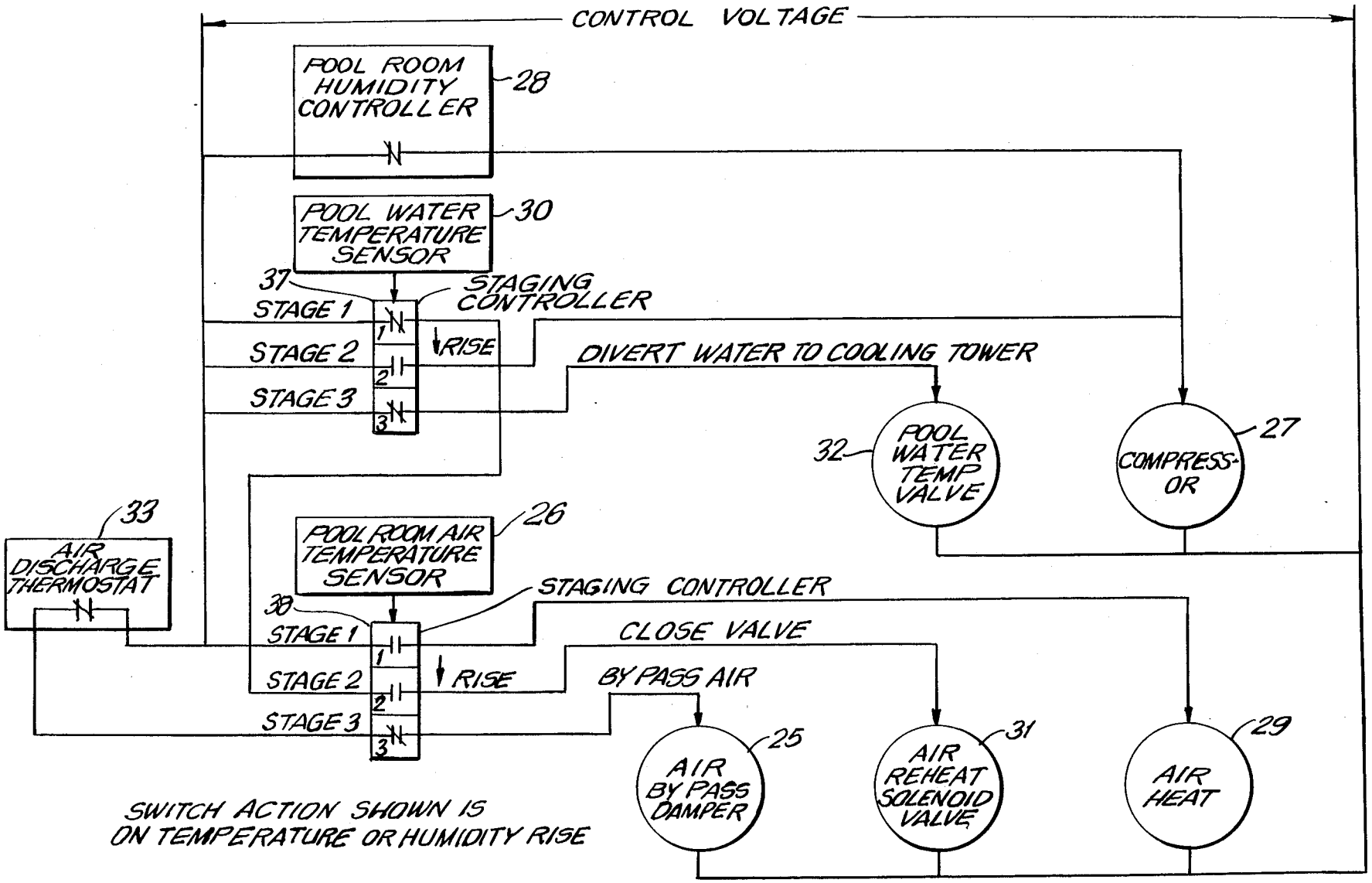
FIG. 3 is a schematic illustration of a control system for the instant invention.

FIG. 3 illustrates a basic schematic for electric wiring of an apparatus according to the invention. The control scheme has a system of priorities to insure optimum use of energy.

In the embodiment of FIG. 3, humidity controller 28 energizes compressor 27 when pool room humidity rises above its set point. Pool water temperature sensor 30 sends a water temperature signal to water temperature staging controller 37. On temperature rise above a set point, stage 1 closes a circuit to hot gas solenoid 31, allowing hot gas to flow to the air reheat coil as determined by stage 2 of a pool roof temperature staging controller 38. On further rise above the set point, stage 2 opens a circuit, de-energizing compressor 27, unless overridden by humidity controller 28. On further rise above the set point, stage 3 closes a circuit to pool water temperature valve 32, thereby diverting warm pool water to a cooling tower to lower its temperature.

Pool room air temperature sensor 26 signals the room air temperature to the air temperature staging controller 38. On temperature rise above the set point, stage 1 opens a circuit to auxiliary heater 29, thereby reducing the heat introduced to the pool air. On further rise above the set point, stage 2 opens a circuit, de-energizing air reheat valve 31 and thereby eliminating heating of the pool air and, when compressor 27 is energized, providing minimum cooling. On further rise above the set point, stage 3 closes a circuit to the air bypass damper actuator 25, directing air to bypass the air-to-air heat exchanger, thereby providing maximum cooling when compressor 27 is energized.

Air discharge thermostat 33 senses air temperature entering the pool room and prevents this air from falling below the dew point temperature, by opening the circuit to stage 3 of the pool room staging controller 38, thereby preventing air bypass.

The invention allows for the dehumidification of air using substantially less external energy than a conventional system, as the air is precooled and reheated using the energy within a closed system itself. One characteristic of the system is the tendency of the air temperature in the pool to increase at times, due to sensible heat sources such as lighting, solar heat and body heat of the occupants of the indoor pool or spa. This characteristic may be overcome in embodiments of the invention by provision and actuation of self-regulating dampers 17 and 23, as aforesaid, which allow the dehumidified and cooled air to exit with variable reheating except as may be limited by discharge temperature control 33.

In another embodiment of the invention, dampers 17 and 23 could be eliminated along with plenum 14, resulting in full flow through the air-to-air heat exchanger.

In another embodiment, the water cooling-tower could be substituted or supplemented with an air-cooled refrigerant condenser for heat rejection.

In another embodiment, a heater could be installed in the pool water pipe for heating during initial warm up or after the water temperature set point is raised. This heater could be in addition to or in lieu of the auxiliary air heating coil 29.

While several embodiments of the present invention have been shown and described herein, it will be understood that many changes and modifications may be made thereto without departing from the spirit and scope of the invention.

I claim:

1. A dehumidification system for high humidity air from an indoor swimming pool, comprising:

air inlet means, air-to-air heat exchange means for precooling said air, first conducting means for directing the precooled air to a dehumidification and cooling coil, second conducting means for directing dehumidified and cooled air from said coil to said heat exchange means for reheating said air, exit means, circulating means for returning said dehumidified and reheated air to said pool, wherein third conducting means connects said inlet means and said dehumidification and cooling coil for bypassing said air-to-air heat exchange means, means for regulating the flow of air in said system from said inlet means directly to said third conducting means and to the dehumidification and cooling coil when the air temperature of the pool air reaches a predetermined temperature level, means for controlling the flow of a cooling medium to said dehumidification and cooling coil when the humidity of the pool air reaches a predetermined level, means for detecting the temperature of the pool air and determining when it reaches said predetermined temperature level, and means for detecting the humidity and determining when it reaches said predetermined humidity level.

2. The dehumidification system of claim 1, wherein said air flow regulating means includes a set of dampers controlled by a thermostat controlling the flow of inlet air in said second or said third conducting means.

3. The dehumidification system of claim 2 wherein a first damper of said regulating means is disposed between the first conducting means and said dehumidification and cooling coil, and a second damper is disposed between said third conducting means and the dehumidification and cooling coil, and further comprising damper control means for closing said first damper and opening said second damper when the air temperature in the pool exceeds a predetermined level.

4. A dehumidification system for high humidity air from a chamber comprising:

an inlet plenum for the air, an air to air stationary heat exchanger for precooling said air, a second plenum for directing the said precooled air to a dehumidification and cooling coil, a third plenum for directing dehumidified and cooled air from said coil to said heat exchanger for reheating said air, an exit plenum, circulating means for returning dehumidified and reheated air to said chamber, a fourth plenum connected between said inlet plenum and said dehumidification and cooling coil for bypassing said air to air heat exchanger, means for regulating the flow or inlet of air in said system from said inlet plenum directly to said fourth plenum to the dehumidification and cooling coil when the temperature of the chamber air reaches a predetermined high temperature level, thus bypassing said heat exchanger, means for controlling the flow of a cooling medium to the said dehumidification and cooling coil when the humidity of the chamber air reaches a predetermined high humidity level, first sensor means for detecting the temperature of the chamber air and determining when it reaches said predetermined high temperature level, and second sensor means for detecting the humidity of said predetermined high humidity level.

5. The dehumidification system of claim 4 wherein said air flow regulating means includes a set of dampers controlled by a thermostat controlling the flow of inlet air in said second or said fourth plenums.

6. The dehumidification system of claim 5 wherein a first damper of said regulating means is disposed between the heat exchanger and said dehumidification and cooling coil, and a second damper is disposed between said fourth plenum and the dehumidification and cooling coil, and further comprising damper control means for closing said first damper and opening the second damper when the air temperature in the pool exceeds a predetermined high level.

* * * * *